US005733231A

United States Patent [19]

Corn et al.

[11] Patent Number: 5,733,231

[45] Date of Patent: Mar. 31, 1998

[54] EXERCISE DEVICE WITH VARIABLE RESISTANCE

[75] Inventors: Joshua A. Corn, 306 S. Main St., Suite 3E, Ann Arbor, Mich. 48104; Scott V. Wells; Steve J. Zwonitzer, both of Atlanta, Ga.

[73] Assignee: Joshua A. Corn, Ann Arbor, Mich.

[21] Appl. No.: 618,525

[22] Filed: Mar. 19, 1996

[51] Int. Cl.[6] ..... A63B 21/018

[52] U.S. Cl. ..... 482/120; 482/127

[58] Field of Search ..... 482/114, 115, 482/118, 120, 127

[56] References Cited

U.S. PATENT DOCUMENTS

| | | |
|---|---|---|
| 481,730 | 8/1892 | Miller . |
| 1,139,126 | 5/1915 | Kerns . |
| 1,432,013 | 10/1922 | Blake . |
| 1,703,375 | 2/1929 | Volk . |
| 2,959,414 | 11/1960 | Saltz . |
| 3,462,156 | 8/1969 | Gentry . |
| 3,804,420 | 4/1974 | Boyd . |
| 4,441,707 | 4/1984 | Bosch . |
| 4,779,866 | 10/1988 | Marshall et al. . |
| 4,944,511 | 7/1990 | Francis . |
| 4,948,119 | 8/1990 | Robertson, Jr. . |
| 4,961,573 | 10/1990 | Wehrell . |
| 5,005,832 | 4/1991 | Van Der Hoeven . |
| 5,137,272 | 8/1992 | Wilkinson . |
| 5,176,377 | 1/1993 | Wilkinson . |
| 5,226,867 | 7/1993 | Beal ..... 482/120 |
| 5,234,395 | 8/1993 | Miller et al. . |
| 5,358,461 | 10/1994 | Bailey, Jr. . |

OTHER PUBLICATIONS

Richard D. Blomberg et al, Conspicuity for Pedestrians and Bicyclists; Definition of the Problem, Development and Test of Countermeasures; pp. i–v, 18.

*Primary Examiner*—Lynne A. Reichard
*Attorney, Agent, or Firm*—Young & Basile, P.C.

[57] ABSTRACT

An exercise apparatus includes a plurality of inelastic, retractable cords, each terminating at a handgrip. A retracting mechanism is provided for retracting the cords. Separate resistance mechanisms are provided to resist each of the cords as the cords are being withdrawn from the retracting mechanism. The resistance mechanisms operate independently of one another. At least one removable disk unit is connectible to the resistance mechanism of the exercise apparatus for incrementally increasing resistance force with respect to unwinding movement of the cords when operably connected to the resistance mechanism. The removable disk units can be preloaded with a predetermined biasing resistance force when assembled during manufacturing, and the biasing resistance force can be maintained while not connected to the main unit of the exercise apparatus. The preload maintenance mechanism maintains the preloaded spring force of the removable disk unit while connected to the main unit, as well as when disconnected from the main unit.

20 Claims, 5 Drawing Sheets

EXERCISE DEVICE WITH VARIABLE RESISTANCE

RELATED APPLICATIONS

This application is related to U.S. patent application Ser. No. 08/156,712 filed on Nov. 24, 1993 for an exercise device with adjustable resistance.

FIELD OF THE INVENTION

This invention relates to an exercise device having replaceable and/or stackable resistance members for use with a variety of different exercise devices, including an exercise device involving a back-and-forth motion of the arms (i.e., during jogging or aerobics), to provide constant, adjustable and/or variable resistance to the muscles of the upper body.

BACKGROUND OF THE INVENTION

Various exercise devices have been proposed that are intended as accessories in jogging or aerobics. Some of these devices rely on the user to provide resistance. For example, U.S. Pat. No. 4,441,707 (Bosch) discloses an exercise belt for joggers. The belt encircles the waist and houses a flexible line which terminates at each end in a handle. However, this device does not have any means of imparting resistance to the line. Instead, the user must supply his own resistance by pushing forward on one handle while resisting the backward movement of the other handle. Therefore, it is difficult for the user of this device to maintain a consistent resistance throughout the range of motion during an extended time period of use.

Some attempts have been made to provide a workout device which imparts resistance to the user. For example, U.S. Pat. No. 5,137,272 (Wilkinson) and U.S. Pat. No. 5,176,377 (Wilkinson) disclose exercise devices to be used for aerobics or walking. These devices rely on elastic cords to provide resistance to the arms and legs of the user. In some embodiments, the devices contain a brake lock which can be used to adjust the resistance of the elastic resistance lines. However, while the brake lock does provide some resistance, the user must still supply some additional resistance by pushing forward on one handle while resisting the backward movement of the other handle. In addition, the nature and placement of the elastic cord is such that the resistance provided extends only halfway through the extension of the arms. Furthermore, because the device uses a single line, it is not possible to exercise one arm independently of the other arm. Finally, the resistance line interfaces with the handles in such a way that the line continually comes into contact with the user's arm during use.

Other devices rely on cables and pulleys to provide resistance. For example, U.S. Pat. No. 4,961,573 (Wehrell) discloses a boxing harness equipped with shoulder straps. The device is worn on the upper body and contains a housing into which a line terminating in hand grips retracts. The housing contains a series of pulleys which provide resistance to the line. The device is optionally fitted with means for making the resistive force selectively adjustable. However, this device is unsuitable for jogging, since it requires the user to hold his hands at chest level, not at waist level, and therefore interferes with the natural stride of a runner. Furthermore, the location of the pulley system directly under the arms of the user causes the pulley system to come into contact with the arms of the user during workout. In addition, because of the location of the harness on the body of the user, the lines are at a small enough angle to the arms of the user to cause them to come into continual contact with the user's arms. Finally, when both handles are attached to the same line, it is not possible to exercise one line independently from the other or to provide a different resistance to each arm as disclosed in one of the embodiments.

The known devices disclose many types of handles used with jogging or aerobics accessories. One prior known device disclosed handles consisting of a handpiece, roughly cylindrical in shape, which fit into the hand of the user, and which was beaded on a circular loop attached to the elastic line. The handpiece-and-loop combination fits securely into the crook of the hand, and it was not necessary for the user to squeeze the handgrip to maintain his hold. Consequently, this type of handgrip provided little workout for the hands and forearms of the user. Another known device disclosed handles which have rigid, U-shaped frames with a grip mounted on the outer, open end, and this configuration suffers from the same infirmity of not providing sufficient workout for the hands and forearms of the user.

In addition, many exercise devices have handles which dangle loosely from the device. This type of design is undesirable for sports such as jogging or aerobics, since the handles tend to come into contact with the body of the user when the device is not in use.

None of the known handles are designed to provide quick release, and thus are unsuitable for safety reasons in sports where falling down is a constant hazard. Conventional handles consisting of a handgrip on a loop require the user to retract his hand from the loop before the handle can be released. This creates a hazard for joggers, who may need to be able to rapidly extend their hands forward to brace for a fall. Loop-type handles interfere with this motion, possibly resulting in serious injury to the user.

The prior known devices generally are incapable of providing generally constant resistance force across an entire anticipated range of movement. In addition, the prior known devices are generally incapable of providing an incremental adjustment or variable resistance force while maintaining the increased resistance force generally constant over the anticipated range of movement.

SUMMARY OF THE INVENTION

The present invention is an exercise device having means for providing variable resistance force in incremental amounts of force as desired, while maintaining the resistance force generally constant over an expected range of movement of the exercise device. The present invention advantageously provides a base assembly or main unit including a housing enclosing a spool having an elongated, flexible, inelastic member wound around the spool and connected to the spool at one end while the opposite end extends outwardly through a wall of the housing to a position external of the housing. Means are provided for biasing the spool in a rotational direction causing the elongated member to normally be rewound around the spool when not subjected to any opposing force, or to a force less than that imposed by the biasing means. Preferably, the biasing means is in the form of a spiral coiled spring having a first end anchored with respect to the housing and a second end anchored with respect to the spool for biasing the spool in a rewinding direction with respect to the elongated flexible member. The spool is mounted within the housing for rotation with respect thereto. The spool includes an aperture coaxial with the rotational axis of the spool and accessible from a position external to the housing.

The spiral coil spring is preferably selected in the main unit to have a spring tension in the range of 0.5 to 100 pounds force, with a preferred range of 10 to 50 pounds force, and a most preferred range of 10 to 25 pounds force. If the exercise device is to be made as a portable exercise unit, such as an exercise device to provide resistance to the muscles of the upper body as an accessory during jogging or aerobics, and other sports involving back-and-forth motion of the arms, the portable unit would include a housing, generally stationary with respect to the user, having a spring tension in the range of 0.5 to 10 pounds force, with a preferred range of 1 to 5 pounds force, and a most preferred range of 1 to 1.5 pounds force.

In order to provide incremental variable resistance force to the exercise device, preferably removable disk units are provided which are connectible to the housing of the main unit and engageable with the aperture of the spool coaxial with the rotatable axis in order to provide an additional resistance force with spring tension in the range of 0.5 to 10 pounds force, a preferred range of 1 to 5 pounds force, and a most preferred range of 1 to 3 pounds force. Preferably, the main resistance force producing unit, whether designed as a portable unit for use by joggers, or a stationary unit for use with other exercise devices, provides a constant resistance force across the intended range of motion. The present invention provides a constant force over an expected range of motion of approximately 60 inches. The constant resistance force is provided in both the extending and retracting direction.

If the main resistance force unit is initially provided with a one pound force spring tension, a one pound resistance force is provided to the forward and backward movement of the elongated flexible member while unwinding and rewinding about the spool within the stationary housing. If additional resistance force is required by the user, a removable disk unit can be connected to the main resistance force unit to increase the resistance force as desired in increments of 0.5 to 10 pounds. For example, by way of illustration and not limitation, an additional removable disk unit having a spring tension force of two pounds could be attached to the main resistance force unit in order to provide a combined resistance of 3 pounds to resist forward and backward movement of the elongated flexible member during extension and retraction within the stationary housing.

Preferably, the biasing means disposed within the removable disk resistance force unit is in the form of a spiral coiled spring. Preferably, the spiral coiled spring has a rectangular cross-section. The spiral coiled spring has one end connected to a removable housing that is connectible to the stationary housing of the main resistance force unit and a second end connected to an elongated shaft engageable operably with the aperture formed coaxial along the rotational axis of the spool of the main resistance force unit.

Means is provided for maintaining a preload on the biasing means disposed within the removable disk unit. The maintaining means can include an enlarged disk connected to and rotatable with the shaft engageable within the coaxial aperture of the spool of the main resistance force unit. The enlarged disk has a spiral groove or track formed in one of the radially extending surfaces, such that the spiral track has a first outer end and a second inner end. A traveler member is engageable with the spiral groove, while being restrained to move radially within a radially extending slot formed in a portion of the housing opposing the spiral groove of the removable disk unit. When adjecent the first outer end of the spiral groove, the traveler engages the outer end of the slot to prevent further unwinding rotation of the spiral coiled spring to maintain the desired preload on the spiral coiled spring disposed within the removable disk resistance force unit. In response to extending movement of the elongated flexible member, the spool and connected shaft of the removable disk resistance force unit rotates, causing the enlarged disk to rotate so that the traveler unit moves from the first outer end position of the spiral groove along the spiral groove inwardly toward the second inner end as the elongated flexible member is further extended out of the stationary housing during unwinding movement of the spool. When the traveler member reaches the second inner end of the spiral groove in the enlarged disk of the removable disk resistance force unit, the traveler prevents further extension or unwinding movement of the elongated flexible member from the spool of the main resistance force unit. When the opposing force on the elongated flexible member is reduced sufficiently, the resistance force of the combined biasing means within the main resistance force unit and the removable disk resistance force unit act to retract the elongated flexible member and rewind the flexible member about the spool within the housing of the main resistance force unit.

It is anticipated that the resistance force units of the present invention can be used in a wide variety of exercise devices, and the illustration of an exercise device for providing resistance to the muscles of the upper body as an accessory in jogging or aerobics or other sports involving a back-and-forth motion of the arms as illustrated and described in the present invention is for purposes of illustration, and not by way of limitation. The present invention preferably provides an even or constant resistance throughout the entire range of motion of the user. The present invention provides variable resistance that is easily incrementally changed, to allow the user to provide for a different degree of difficultly from one workout to the next, or to adjust the level of difficulty or resistance force during a single workout.

Preferably in the illustrated embodiment, the handle of the device is constructed so that the user can maintain a steady grip on the handles by inserting the narrowed portion between the thumb and forefinger and providing an enlarged lobe for engagement within the palm of the user's hand. The handle design allows the user to release the handle simply by opening the space between the user's thumb and forefinger. This is an important safety feature in that it enables the user to rapidly extend his arm forward when necessary to brace for a fall. In the illustrated embodiment, the location of the device on the user's waist causes the flexible line or cord to be at a sufficiently large angle to the arms of the user that there is minimal contact between the line and the arms of the user. Contact with the line is also minimized by the construction of the handgrips, which are attached to the line only at one end. The orientation of the device on the waist of the user provides resistance along the natural pathway of a runner's stride. Furthermore, the waist is relatively stationary, and the location of the housing of the exercise device on the user's waist avoids interference with the natural motion of the user. This orientation and location of the exercise device interferes less with the user's circulation than devices that use a shoulder harness.

The elongated flexible inelastic members of the present invention, such as cables, cords or the like are retractable. This provides resistance for the arms on both the forward and backward movements. When not in use, the handles can be held relatively stationary with respect to the housing situated at the user's side. This provides unobtrusive positioning of the exercise device when the device is not in use, and prevents or reduces interference with the user's movement. The present invention also provides separate resistance means for resisting movement of each arm or limb. This permits a user to exercise one arm or limb at a time, or to provide a different degree of resistance for each arm or limb, a feature particularly desirable for rehabilitation purposes.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
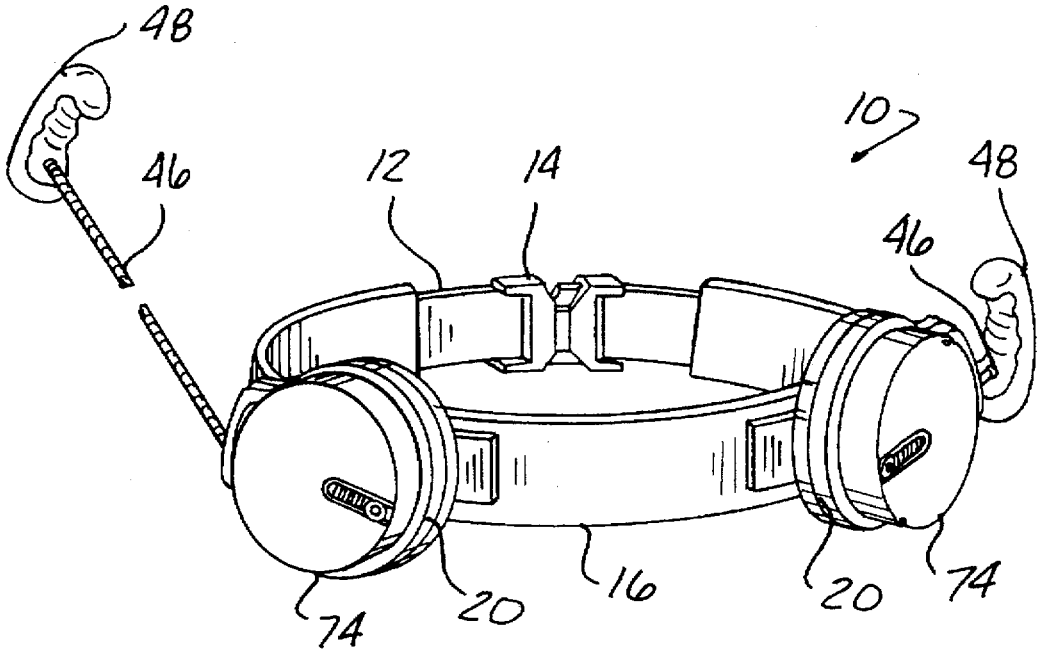
FIG. 1 is a perspective view of an exercise apparatus according to the present invention.
Figure 2:
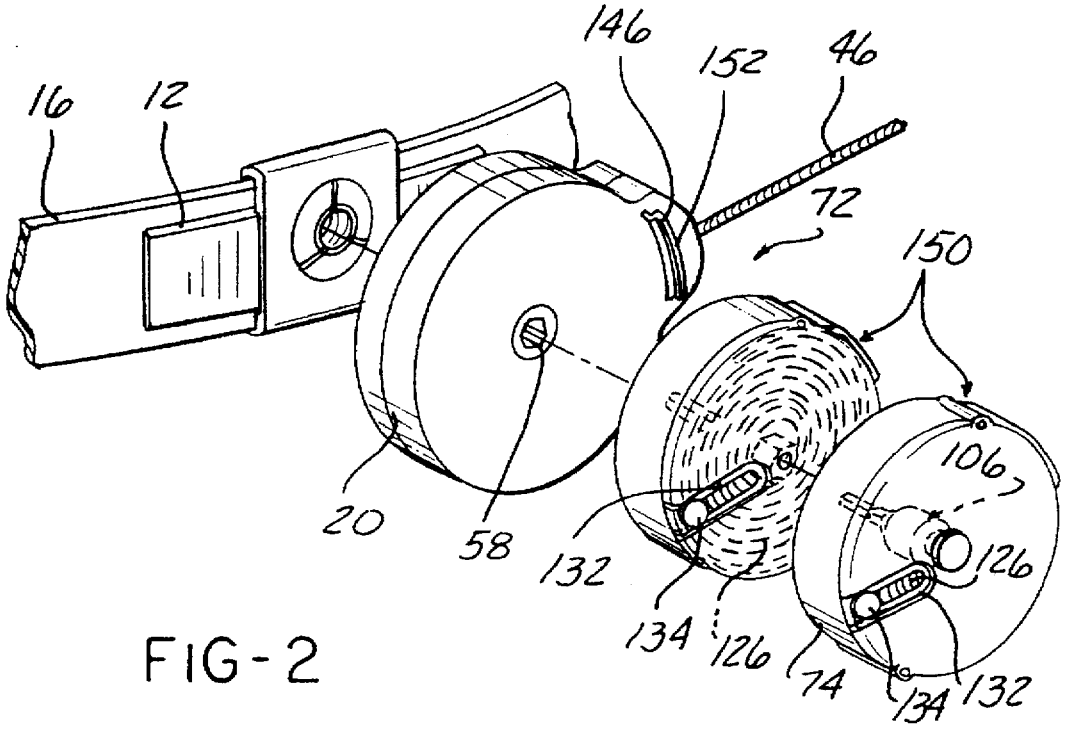
FIG. 2 is a detailed exploded view of a main resistance force unit and at least one removable disk resistance force unit according to the present invention.
Figure 3:
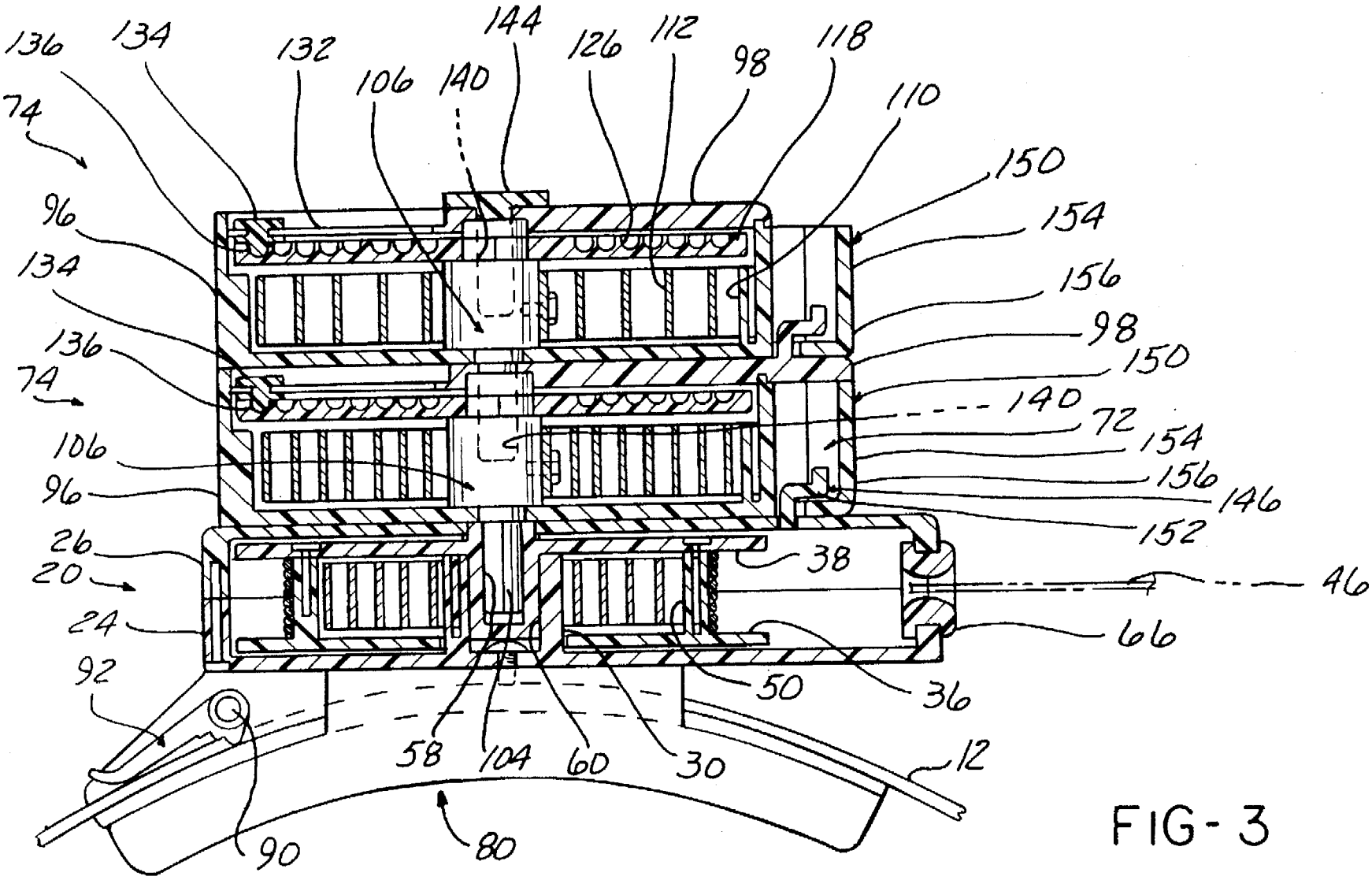
FIG. 3 is a cross-sectional view illustrating at least one removable disk resistance force unit operably connected to a main resistance force unit according to the present invention.

An exercise apparatus 10 according to the present invention is illustrated in perspective view in FIG. 1. The disclosure of the present invention is related to the exercise device with adjustable resistance disclosed in U.S. patent application Ser. No. 08/156,712 filed on Nov. 24, 1993 which is incorporated by reference herein in its entirety. For purposes of illustration, and not by way of limitation, the illustrated exercise apparatus is in the form of a belt 12 engageable around the waist of a user for increasing the upper body workout during jogging or aerobics. The belt 12 may include an adjustable and releasable clasp 14 and padding 16 enclosing a portion of the belt 12. This type of exercise apparatus 10 will be referred to as a portable unit engageable in a stationary manner with respect to the user. It is anticipated that other types of exercise devices may be designed and incorporate the resistance force units according to the present invention. For example, by way of illustration and not limitation, the resistance force unit according to the present invention could be adapted for use with a rowing machine, a bench press, a leg lift, a stepper, an aerobic glide device, or other type of exercise apparatus having forward and back repetitive movements. The present invention is particularly well suited for repetitive movements where it is desired to provide resistance force across the entire range of movement, and particularly where constant resistance force is desired over the entire range of movement while providing means for incrementally increasing the resistance force as desired. For larger types of exercise devices, such as rowing machines, bench presses, steppers, gliders, or leg lifts, these will be referred to as stationary units where the housing of the stationary unit is held in stationary position with respect to the support frame of the exercise apparatus, and the user may move with respect to the frame and/or the housing depending on the particular configuration of the exercise apparatus.

In either case, the portable unit and the stationary unit preferably include a main resistance force assembly or unit 20. As best seen in FIGS. 1–3 and 6, the main resistance force unit 20 can include a housing 22 stationary with respect to a support member, such as belt 12 or other support frame member (not shown), and/or the user. The housing 22 can include a first portion 24 and a second portion 26 engageable with one another to enclose a spool 28. The spool 28 is rotatably received on a longitudinally extending hollow post 30 extending inwardly within the enclosed space of the housing 22 from one radially extending sidewall. The post 30 includes a longitudinally extending slot 32 for anchoring one end of means 34 for biasing the spool 28 in a rewinding rotational direction.

The spool 28 can be formed of a first part 36 and a second part 38 adapted to be connected to one another by any suitable means for enclosing the biasing means 34 within a hollow portion of the spool 28 formed when the first and second parts are assembled together. The first part 36 of the spool can include a radially extending wall 40 having an aperture 42 formed therein for rotatably mounting the spool 28 with respect to the post 30 and the first portion 24 of the housing 22. The first part 36 of the spool 28 may also include an axially extending cylindrical wall 44 for receiving a predetermined length of an elongated, flexible, inelastic member 46 wound around an external surface of the cylindrical wall 44. The elongated member 46 is connected to a handle 48 at one end external to the housing 22 and is connected to the spool 28 at an opposite end (not shown) by any suitable means. The cylindrical wall 44 can also include an internal surface defining a hollow interior space adapted to receive the biasing means 34. The interior hollow space of the spool 28 defined by the interior surface of the cylindrical wall 44 may also include an anchor 50 extending axially out of the radially extending wall 40 for receiving an opposite end of the biasing means 34 from the end anchored in slot 32 of the post 30.

Preferably, the biasing means 34 can include a spiral coiled spring 52 having a first inner end anchored within the slot 32 of the post 30 connected to the first portion 24 of the housing 22 and a second radially outward end connected to the anchor 50 connected to the first part 36 of the spool 28. The spiral coiled spring 52 preferably has a rectangular cross-section in order to provide the preferred constant or even resistance force throughout the entire anticipated range of movement for the exercise apparatus 10. A second part 38 of the spool 28 can be provided to enclose the spiral coiled spring 52 within the hollow space between the first part and the second part, 36 and 38, of the spool 28. The second part 38 of the spool 28 can include a second radially extending wall 54 to define a reduced diameter portion corresponding to the axially extending cylindrical wall 44 between wall 40 and wall 54 for receiving the coil of elongated inelastic member 46 wound around the spool 28. An elongated shaft 56 extends longitudinally along the rotational axis of the spool 28 to engage within the hollow portion of the post 30 extending outwardly from the first portion 24 of the housing 22. The elongated shaft 56 includes a longitudinally extending aperture therein accessible from a position external to the housing 22. The spool 28 rotates about the post 30 with aperture 42 in the radially extending wall 40 rotatably sliding with respect to the external surface of post 30, while the elongated shaft 56 extending longitudinally from the second radial extending wall 54 rotatably engages within a longitudinally extending aperture 60 formed in the post 30. Enclosed within the hollow spool 28 is a first spiral coiled spring 52 having a first end engageable and anchored within the slot 32 in the post 30 and an opposite end engageable with and anchored with respect to an anchor 50 connected to the spool 28. The externally accessible longitudinally extending aperture 58 formed in the elongated shaft 56 preferably provides means for operably connecting additional biasing means for incrementally increasing the resistance force of the exercise device 10.

The aperture 58 of the elongated shaft 56 is accessible externally of the housing through an aperture 62 formed in a radially extending wall 64 of the second portion 26 of the housing 22. The first and second portions, 24 and 26 respectively, of the housing 22 can be connected to one another by any suitable means. Preferably, the housing 22 substantially encloses the moving parts of the exercise apparatus 10, such as the spool 28 and biasing means 34 in order to prevent injury to the user, or failure of the exercise apparatus 10 due to the entry or contact of foreign material with the moving parts of the exercise apparatus 10. A grommet 66 may be provided engageable within opposing slots 68 and 70 formed in respective first and second portions, 24 and 26, of the housing 22. The grommet 66 can provide protection for the elongated inelastic member 46 as it passes from its position wound around the spool 28 through the sidewall of the housing 22 to a position external of the housing where it connects to the handle 48. Means 72 is provided for coupling an additional incremental resistance force increasing unit or removable disk unit 74 to the housing 22. Means 76 is also provided for connecting an additional biasing means 78 of the removable disk unit 74 to the biasing means 34 of the main resistance force unit 20. Means 80 is provided for supporting the main resistance force unit 20 from a suitable support member, such as a frame of a stationary exercise apparatus 10, or the belt 12 of a portable exercise apparatus 10.

The supporting means 80 can be connected to the housing 22 by any suitable means. In the case of a portable exercise apparatus 10 as that illustrated, the supporting means 80 can include an elongated generally rectangular member 82 of planar or contoured form having a slot 84 defined by the member 82 and the housing 22 when the member 82 is connected by any suitable means to the housing 22. The slot 84 provides passage for the belt 12 between the member 82 and the housing 22. The member 82 also includes outwardly extending flanges or tabs 86 and 88 having coaxial apertures formed therethrough for receipt of a pivot pin 90. A rotatable wedge member 92 is supported on the pivot pin 90 for rotation to wedgingly engage the belt 12 between the wedge member 92 and the support member 82 to lockingly engage the housing 22 in any desired position along the belt 12.

The removable disk unit 74 is best seen in FIGS. 2–5 and 7. The removable disk resistance force unit 74 can include a second housing 94 for enclosing additional or second biasing means 78. The second housing 94 can be formed having a first portion 96 and a second portion 98 adapted to be connected to one another by any suitable means in order to define a hollow chamber therebetween. The first portion 96 can include a radially extending wall 100 having an aperture 102 formed therethrough allowing passage of a complimentary shaped portion 104 of an elongated shaft 106 disposable coaxial with the rotational axis of the spool 28. The shaft portion 104 is complimentary in shape to the aperture 58 formed in the spool 28 to operably engage the second biasing means 78 with the first biasing means 34 by engaging the shaped shaft portion 104 within the aperture 58 so that the first and second elongated shafts 56 and 106 respectively rotate in unison with one another. The aperture 58 and shaft portion 104 define the connecting means 76 for incrementally increasing the resistance force of the exercise apparatus 10 when the removable disk unit 74 is attached to the main unit 20. The elongated shaft 106 includes an enlarged portion disposed within the hollow chamber defined by the first and second portions, 96 and 98 respectively, of the second housing 94. The enlarged portion 108 is adapted to operably engage one end of the second biasing means 78. An opposite end of the second biasing means 78 is engageable with an anchor 110 extending longitudinally outwardly from the radially extending wall 100 into the hollow chamber between the first and second portions, 96 and 98 respectively, of the second housing 94. Preferably, the second biasing means 78 is a second spiral coiled spring 112 having a first end connected to the enlarged portion 108 of the elongated shaft 106 and an opposite end connected to the anchor 110 of the second housing 94. Preferably, the second spiral coiled spring 112 has a rectangular cross-section. The one end of the second spiral coiled spring 112 can be connected to the enlarged portion 108 of the elongated shaft 106 by any suitable means, such as by an aperture formed in the enlarged portion 108 and a corresponding aperture adjacent one end of the coiled spring which are alignable coaxially with one another and securable together by a threaded screw. Any other form of suitable attachment can also be employed for anchoring the respective ends of the spiral coiled spring members 52 and 112. The second biasing means 78 urges the elongated shaft 106 in a predetermined rotational direction corresponding to the rewinding direction of the spool 28, incrementally increasing and adding additional resistance force against unwinding movement of the elongated member 46 from the spool 28.

It is desirable in the present invention to provide the second biasing means 78 with a preload that is maintained when the removable unit 74 is disconnected from the main unit 20. Means 114 is provided for maintaining a predetermined preload on the second biasing means 78 corresponding to the additional incremental resistance force of the particular removable disk unit 74. The maintaining means 114 can include an annular member 116 having a radially extending wall 118 in facing opposition to a radially extending wall 120 of the second portion 98 of the second housing 94. The annular member 116 can include an aperture 122 formed therein for non-rotatable connection with respect to the elongated shaft 106. In the alternative, the annular member 116 may be formed integrally with the elongated shaft 106. The aperture 122 may take the form of a rectangular shaped aperture cooperatively engageable with a rectangular shaped portion 124 of the elongated shaft 106. The radially extending wall 118 of the annular member 116 preferably includes a spiral track or groove 126 having a first radially outer end 128 and a second radially inward end 130. The second portion 98 of the second housing 94 can include a radially extending slot 132.

A traveler 134 is slidably engaged with the slot 132 in the radially extending wall 120 of the second portion 98 of the second housing 94 for reciprocating motion radially between a first position and a second position. A protruding portion 136 of the traveler 134 cooperatively engages with the spiral track or groove 126 in the radially extending wall 118 of the annular member 116 as the traveler 134 reciprocates between the first and second end limits of travel in the slot 132. When the traveler 134 is in the first radially outward position of the slot 132 and the protruding portion 136 is engaged within the spiral track or groove 126 at the first end 128, the second spiral coiled spring 112 is maintained in the desired preloaded condition as determined when the removable disk unit 74 was assembled. As the elongated member 46 is unwound from the spool 28, the protruding portion 136 follows the spiral track 126 driving the traveler 134 radially inwardly along the slot 132 formed in the radially extending wall 120 of the second housing 94. When the protruding portion 136 of the traveler 134 reaches the second end 130 of the spiral track or groove 126, further extending movement of the elongated member 46 from the housing 22 is prevented.

When traveling between the first end 128 and the second end 130 of the spiral track or groove 126, the combined resistance force of the first biasing means 34 and the second biasing means 78 is acting against unwinding rotary movement of the spool 28. When sufficient force is removed from the elongated member 46, the unwinding rotation of spool 28 ceases, and when the force on elongated member 46 falls below the combined resistance force of the first biasing means 34 and the second biasing means 78, the spool is driven in the rewinding direction in order to retract the elongated member 46 as it is rewound about the spool 28. If it is desirable to stack or connect more than one removable disk unit 74 with respect to one another, or with respect to the main unit 20, the elongated shaft 106 can include an end portion 138 accessible from a position external to the second housing 94 having a longitudinally extending aperture 140 to define means for connecting additional biasing means similar to that provided by connecting means 76 defined by aperture 58 in shaft 56 and the complimentary shaped shaft portion 104 of elongated shaft 106. The second portion 98 of the second housing 94 can be formed with an aperture 142 permitting access to the aperture 140 from a position external to the second housing 94. The aperture 142 may be closed to prevent entry of foreign matter by a cap 144.

Means 72 is provided for coupling the removable disk unit 74 to the main unit 20, and more specifically for coupling the first housing 22 to the second housing 94 in order to allow the connecting means 76 to provide the combined resistance force of the first biasing means 34 and the second biasing means 78 acting in combination with respect to coupled first and second housings, 22 and 94 respectively. The coupling means 72 can include an outwardly extending projection 146 connected to at least one of the first housing 22 or the second housing 94 and a complimentary shaped aperture or slot 148 formed in the other of the second housing 94 or the first housing 22 for slidably receiving the projection 146 within the slot 148. Means 150 is provided for releasing the projection 146 from the aperture or slot 142 when it is desired to remove the removable disk unit 74 from the main unit 20.

In the illustrated embodiment, the projection 146 can include a longitudinally and radially outwardly projecting stepped flange-like arcuate member 152 connected to the second portion 26 of the first housing 22. The aperture or slot 148 in the illustrated embodiment can be in the form of an enlarged lobe 154 formed in the longitudinally extending sidewall of the removable disk 74 with a complimentary shaped slot 148 formed in the longitudinally extending sidewall of the lobe 154. The releasing means 150 can take the form of a cantilevered portion 156 of the enlarged lobe 154 that can be pressed radially inwardly at its outer cantilevered end 158 in order to release the arcuate flange-like member 152 through the complimentary shaped slot 148 formed in the longitudinally extending sidewall 160 of the enlarged lobe 154. To engage the arcuate flange-like member 152 within the enlarged lobe 154, the shaft portion 104 of the elongated shaft 106 is longitudinally engaged within the aperture 58 of the elongated shaft 56, and then the removable drive unit is rotated about the rotational axis of the spool 28 in order to rotate the flange-like member 152 and enlarged lobe 154 with respect to one another until they come into locking engagement. To release the removable disk unit 74 from the main unit 20, the outer cantilevered end 158 of the enlarged end 154 is pressed radially inwardly in order to align the complimentary shaped slot 148 with the arcuate flange-like member 152 cross-section, permitting rotation of the removable disk unit 74 with respect to the main unit 20 to disengage the arcuate flange-like member 152 from the enlarged lobe 154 by sliding through the complimentary shaped slot 148 as the removable disk unit 72 is rotated with respect to the main unit 20.

Figure 4:
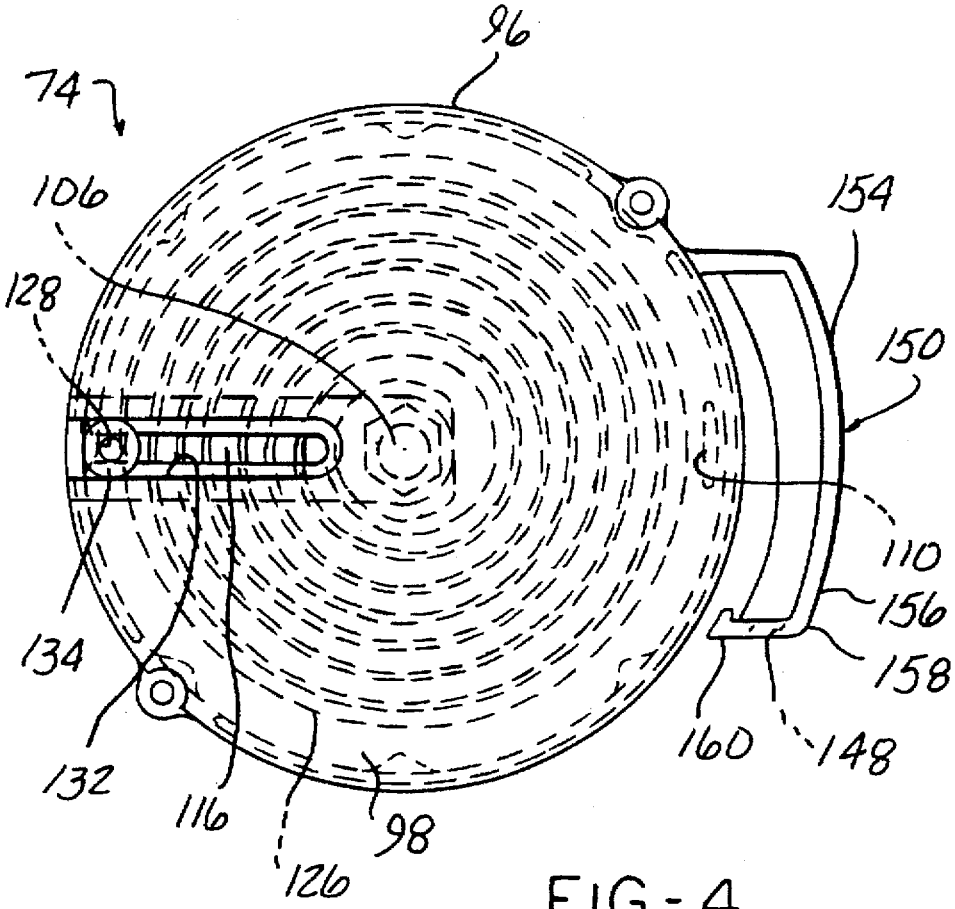
FIG. 4 is a plan view of a removable disk resistance force unit according to the present invention.
Figure 5:
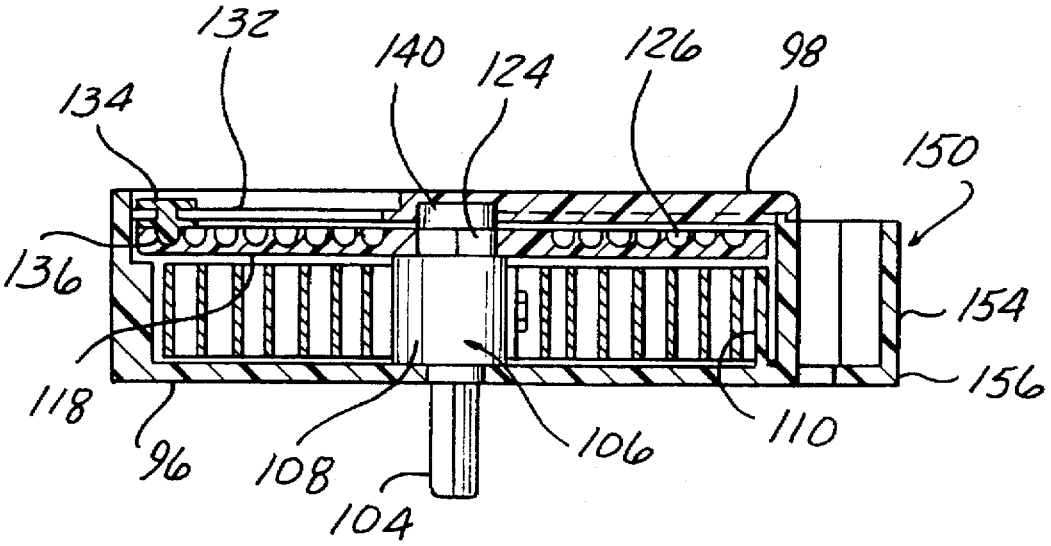
FIG. 5 is a cross-sectional view of a removable disk resistance force unit.
Figure 6:
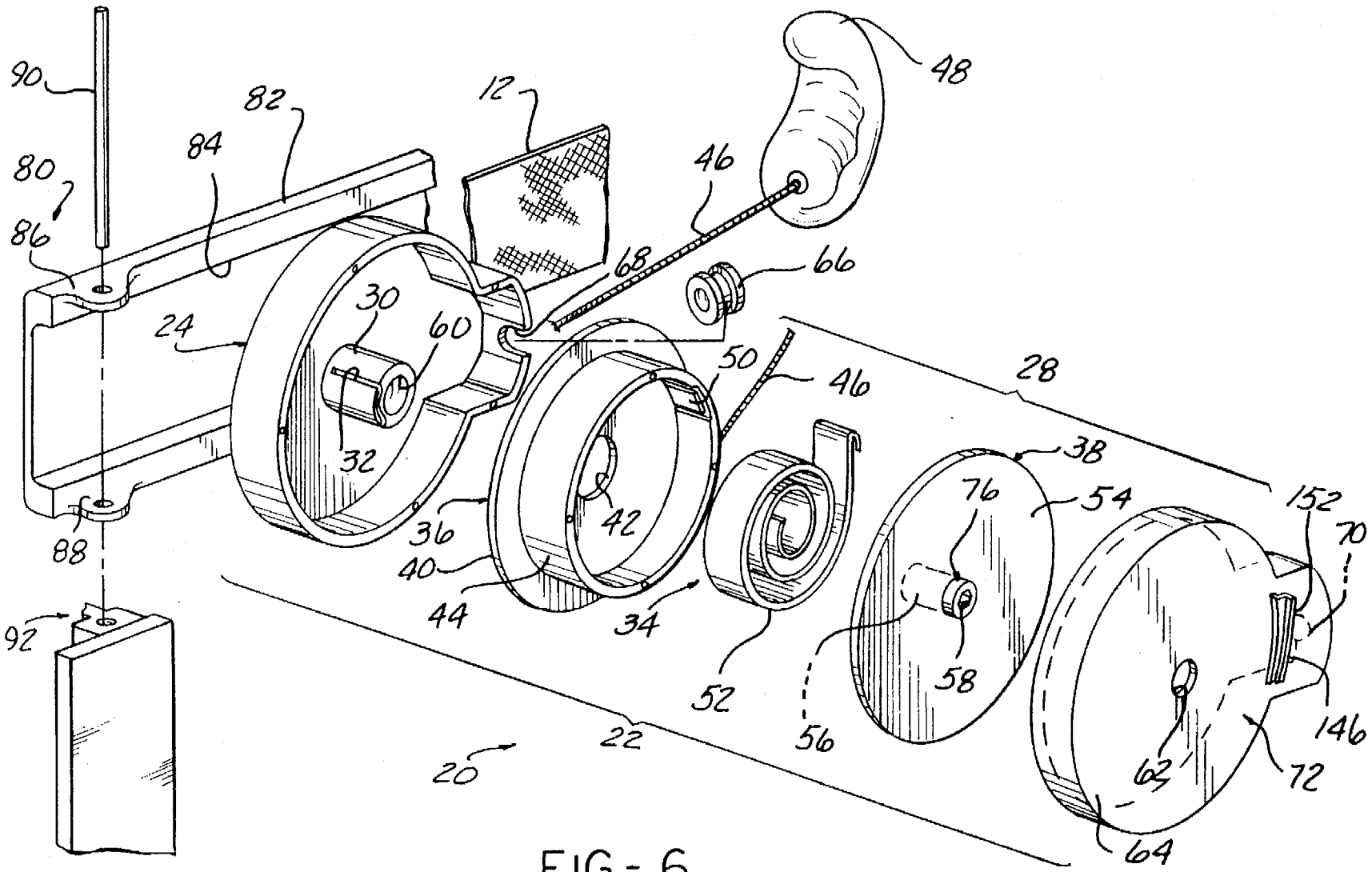
FIG. 6 is an exploded view of a main resistance force unit according to the present invention.
Figure 7:
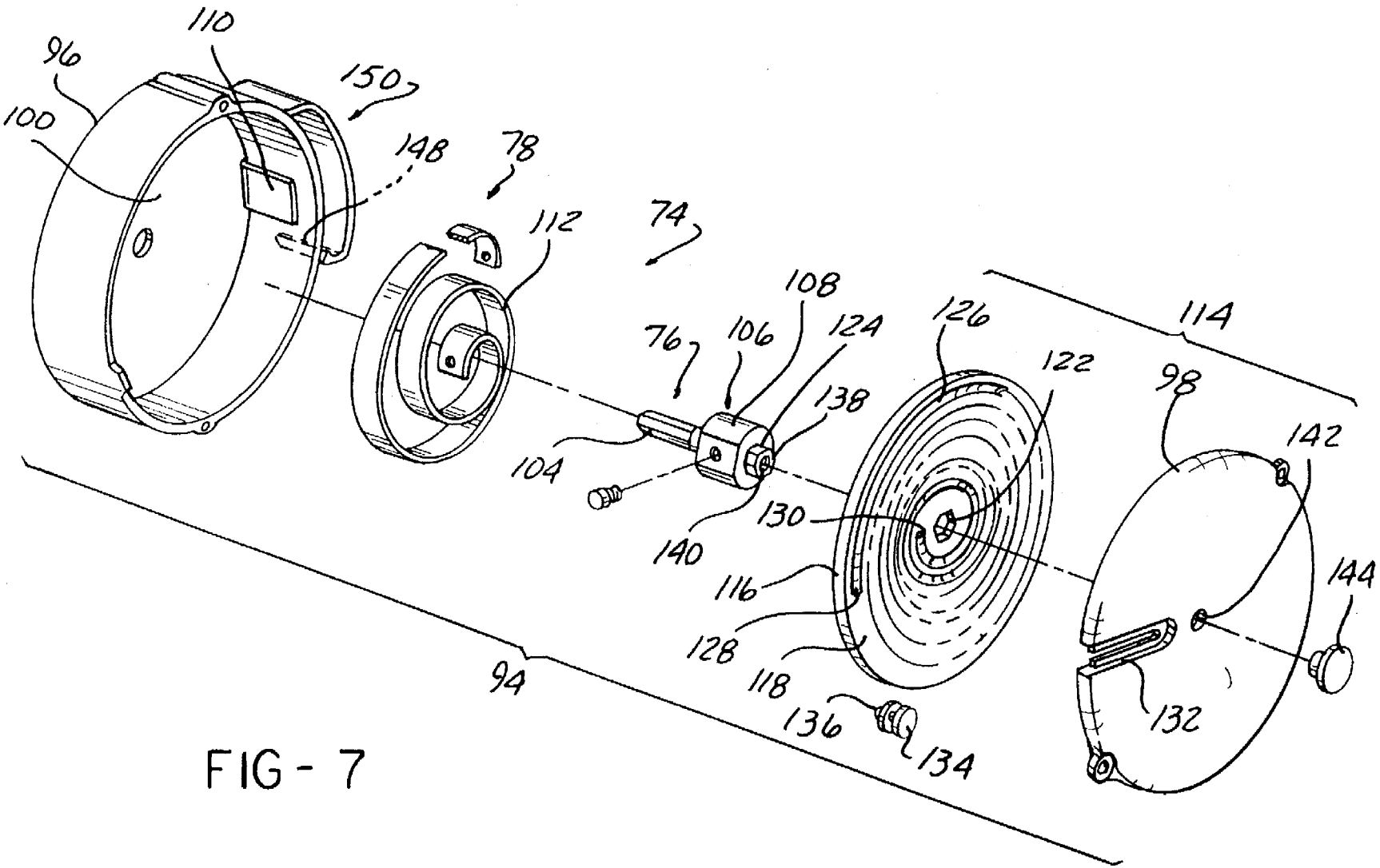
FIG. 7 is an exploded view of a removable disk resistance force unit according to the present invention.

If desired, the second portion 98 of the second housing 94 can be enlarged from that illustrated in FIGS. 4 and 5 in order to cover the outer end of the enlarged lobe 154 to prevent entry of foreign articles therein. While the projection 146 has been illustrated connected to the main unit 20, and the slot 148 formed in the removable disk unit 74, it should be recognized that this particular structural configuration could be reversed without departing from the spirit and scope of the present invention.

The present invention provides removable disk units that can be preloaded with a predetermined biasing resistance force when assembled during manufacturing, and the biasing resistance force can be maintained while not connected to the main resistance force unit of the exercise apparatus. The ability to maintain a preload resistance force in a separable unit is desirable in order to provide a constant resistance force over the anticipated distance of travel for the particular exercise machine immediately after connecting the separable unit to the main unit, without requiring several extensions and retractions to build up the desired resistance force after connection. This feature reduces or eliminates undesirable interruptions in the work out of the user when changing the desired resistance force by adding one or more separable disk units to the main unit.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An exercise apparatus comprising:

at least one inelastic, flexible, elongated member;

storage means for storing at least a portion of said elongated member; and pretensioned, non-adjustable, resistance means for resisting withdrawal of said stored portion of said elongated member from said storage means with a substantially constant resistance force over a predetermined range of movement.

2. An exercise apparatus comprising:

at least one inelastic, flexible, elongated member;

storage means for storing at least a portion of said elongated member;

pretensioned resistance means for resisting withdrawal of said stored portion of said elongated member from said storage means with a substantially constant resistance force over a predetermined range of movement; and separable pretensioned resistance means for incrementally increasing said substantially constant resistance force to withdrawal of said stored portion of said elongated member from said storage means when said separable pretensioned resistance means is connected to said pretensioned resistance means.

3. The exercise apparatus of claim 2 further comprising:

means for maintaining a preloaded resistance force with respect to an axis of rotation in said separable pretensioned resistance means while separated from said storage means.

4. The exercise apparatus of claim 2 wherein said storage means further comprises:

a first housing having an elongated post defining a longitudinally extending axis of rotation and a first radially extending wall;

spool means rotatable engageable on said post for rotation with respect to said axis of rotation, said spool means for storing said portion of said elongated member by winding about said spool means when rotated in a first direction and for dispensing said stored portion of said elongated member as said spool means is rotated in a second direction opposite to said first direction; and first biasing means for urging said spool means in said first direction of rotation.

5. The exercise apparatus of claim 2 further comprising:

means for supporting said storage means from a support member.

6. The exercise apparatus of claim 2 wherein said pretensioned resistance means further comprises:

a spiral coiled spring.

7. The exercise apparatus of claim 6 wherein said spiral coiled spring has a rectangular cross-section.

8. An exercise apparatus comprising:

at least one inelastic, flexible, elongated member;

storage means for storing at least a portion of said elongated member, wherein said storage means further includes a first housing having an elongated post defining a longitudinally extending axis of rotation and a first radially extending wall, spool means rotatably engageable on said post for rotation with respect to said axis of rotation, said spool means for storing said portion of said elongated member by winding about said spool means when rotated in a first direction and for dispensing said stored portion of said elongated member as said spool means is rotated in a second direction opposite to said first direction, and first biasing means for urging said spool means in said first direction of rotation;

pretensioned resistance means for resisting withdrawal of said stored portion of said elongated member from said storage means with a substantially constant resistance force over a predetermined range of movement; and separable pretensioned resistance means engageable with said spool means for incrementally increasing said substantially constant resistance force to withdrawal of said stored portion of said elongated member from said spool means when said separable pretensioned resistance means is connected to said spool means.

9. The exercise apparatus of claim 8 wherein said separable pretensioned resistance means further comprises:

a second housing having a second wall extending radially with respect to said axis of rotation with an aperture disposed coaxial with said axis of rotation;

an elongated shaft engageable through said aperture in said second wall for operably connecting with said spool means; and second biasing means for urging said elongated shaft in said first direction of rotation with respect to said axis of rotation.

10. The exercise apparatus of claim 9 further comprising:

means for maintaining a preloaded resistance force with respect to said axis of rotation in said separable pretensioned resistance means while separated from said storage means.

11. The exercise apparatus of claim 9 further comprising:

means for connecting said second housing to said first housing.

12. The exercise apparatus of claim 11 wherein said connecting means further comprises:

an outwardly extending shaped projection from one of said first and second housings;

a complementary shaped aperture formed in the other of said first and second housings for slidably receiving said shaped projection; and means for releasibly locking said shaped projection with respect to said aperture.

13. An exercise apparatus comprising:

at least one inelastic, flexible, elongated member;

storage means for storing at least a portion of said elongated member, wherein said storage means includes a first housing having an elongated post defining a longitudinally extending axis of rotation and a first radially extending wall, spool means rotatably engageable on said post for rotation with respect to said axis of rotation, said spool means for storing said portion of said elongated member by winding about said spool means when rotated in a first direction and for dispensing said stored portion of said elongated member as said spool means is rotated in a second direction opposite to said first direction, and first biasing means for urging said spool means in said first direction of rotation;

resistance means for resisting withdrawal of said stored portion of said elongated member from said storage means;

separable resistance means engageable with said spool means for incrementally increasing resistance force to withdrawal of said stored portion of said elongated member from said spool means when said separable resistance means is connected to said spool means, wherein said separable resistance means includes a second housing having a second wall extending radially with respect to said axis of rotation with an aperture disposed coaxial with said axis of rotation, an elongated shaft engageable through said aperture in said second wall for operably connecting with said spool means, and second biasing means for urging said elongated shaft in said first direction of rotation with respect to said axis of rotation; and means for maintaining a preloaded resistance force with respect to said axis of rotation in said separable resistance means while separated from said storage means, wherein said maintaining means includes an annular member connected to said elongated shaft for rotation therewith, at least one spiral track formed in said annular member having a first end and a second end, and traveler means for reciprocating movement radially between first and second end limits of travel, said traveler means including at least one protruding portion operably engageable with said at least one spiral track, such that when said traveler means is in said first end limit of travel and said protruding portion is at said first end of said spiral groove, said separable resistance means is maintained in a preloaded resistance force state when disconnected from said storage means.

14. The exercise apparatus of claim 13 further comprising:

said traveler means for preventing further withdrawal of said elongated member from said storage means when said traveler means is in said second end limit of movement and said protruding portion is in at said second end of said spiral groove.

15. An exercise apparatus comprising:

at least one inelastic, flexible, elongated member;

storage means for storing at least a portion of said elongated member, wherein said storage means includes a first housing having an elongated post defining a longitudinally extending axis of rotation and a first radially extending wall, spool means rotatably engageable on said post for rotation with respect to said axis of rotation, said spool means for storing said portion of said elongated member by winding about said spool means when rotated in a first direction and for dispensing said stored portion of said elongated member as said spool means is rotated in a second direction opposite to said first direction, and first biasing means for urging said spool means in said first direction of rotation;

resistance means for resisting withdrawal of said stored portion of said elongated member from said storage means;

separable resistance means engageable with said spool means for incrementally increasing resistance force to withdrawal of said stored portion of said elongated member from said spool means when said separable resistance means is connected to said spool means, wherein said separable resistance means includes a second housing having a second wall extending radially with respect to said axis of rotation with an aperture disposed coaxial with said axis of rotation, an elongated shaft engageable through said aperture in said second wall for operably connecting with said spool means, and second biasing means for urging said elongated shaft in said first direction of rotation with respect to said axis of rotation; and means for connecting said second housing to said first housing, wherein said connecting means includes an outwardly extending shaped projection from one of said first and second housings, a complementary shaped aperture formed in the other of said first and second housings for slidably receiving said shaped projection, and means for releasibly locking said shaped projection with respect to said aperture, wherein said releasible locking means includes a lock member connected to one of said first and second housings, said lock member moveable between a first position locking said shaped projection with respect to said aperture and a second position permitting disengagement of said shaped projection with respect to said aperture.

16. An exercise apparatus comprising:

at least one inelastic, flexible, elongated member;

storage means for storing at least a portion of said elongated member;

resistance means for resisting withdrawal of said stored portion of said elongated member from said storage means; and means for supporting said storage means from a support member, wherein said supporting means includes a belt engageable around a waist of a user, a support bracket having a slot formed therein and connected to the storage means such that said slot is disposed between said member and said storage means for receipt of said belt therethrough, and pivotable wedge means connected to said support bracket for releasibly locking said belt between said support bracket and said wedge means in any desired location along said belt.

17. An exercise apparatus comprising:

at least one inelastic, flexible, elongated member;

storage means for storing at least a portion of said elongated member;

pretensioned resistance means for resisting withdrawal of said stored portion of said elongated member from said storage means with a substantially constant resistance force over an anticipated range of movement;

separable pretensioned resistance means for incrementally increasing said substantially constant resistance force to withdrawal of said storage portion of said elongated member from said storage means when said separable pretensioned resistance means is connected to said pretensioned resistance means; and means for releasibly connecting said separable pretensioned resistance means to said pretensioned resistance means.

18. The exercise apparatus of claim 17 further comprising:

means for maintaining a preloaded resistance force with respect to an axis of rotation in said separable pretensioned resistance means while separated from said pretensioned resistance means.

19. The exercise apparatus of claim 18 further comprising:

means for supporting said storage means from a support member.

20. In an exercise apparatus having means for resisting rotational movement in a first direction, the improvement comprising:

at least one removable disk means selectively connectible to said rotational movement resisting means for incrementally increasing resistance force to rotational movement in said first direction when operably connected to said rotational movement resisting means, said disk means permanently held in a pretensioned state for providing a substantially constant resistance force over an anticipated range of movement when connected to said resisting means, while holding said pretensioned state when disconnected from said resisting means.

* * * * *